United States Patent [19]

Kashiwaba

[11] Patent Number: 4,709,868

[45] Date of Patent: Dec. 1, 1987

[54] SETTING AND WINDING MECHANISM FOR TAPE-LIKE LAMINATE IN LAMINATOR

[75] Inventor: Tadao Kashiwaba, Iwate, Japan

[73] Assignee: Kabushiki Kaisha Sato, Japan

[21] Appl. No.: 832,041

[22] Filed: Feb. 21, 1986

[30] Foreign Application Priority Data

Feb. 28, 1985 [JP] Japan ..... 60-37532

[51] Int. Cl.[4] ..... B65H 54/71; B26D 5/20

[52] U.S. Cl. ..... 242/56 R; 83/37; 83/371

[58] Field of Search ..... 83/37, 74, 75, 156, 83/289, 371; 242/56 R, 58, 58.1, 58.2, 58.3, 58.4

[56] References Cited

U.S. PATENT DOCUMENTS 3,558,070 1/1971 Gabriels ..... 242/56 R
4,426,898 1/1984 Friberg ..... 83/74 X
4,494,435 1/1985 Lindsay ..... 83/37 X
4,543,863 10/1985 Rader ..... 83/74 X

FOREIGN PATENT DOCUMENTS 2429917 1/1975 Fed. Rep. of Germany ..... 242/58.2
2090582 7/1982 United Kingdom ..... 242/56 R

*Primary Examiner*—Daniel P. Stodola
*Attorney, Agent, or Firm*—Ostrolenk, Faber, Gerb & Soffen

[57] ABSTRACT

A setting and winding mechanism for a tape-like laminate in a laminator for facilitating the initial setting of tape-like materials to the laminator while avoiding the waste of materials. The mechanism comprises a feeding device for feeding a laminate strip, a sensor to detect the position of the laminates strip, a cutter to cut the laminate strip into laminate pieces, a delivery device to deliver the cut laminate pieces, a take-up device to initially wind up the free end of the laminate strip, and a drive controlling device connected to operate both of the delivery and take up devices in a desired sequence.

3 Claims, 4 Drawing Figures

SETTING AND WINDING MECHANISM FOR TAPE-LIKE LAMINATE IN LAMINATOR

BACKGROUND OF THE INVENTION

1. Field of the Invention

This invention relates to a setting and winding mechanism for a tape-like laminate in a laminator in which a transparent tape-like film is laminated on a printing medium such as an array of labels or tags and the obtained laminate is cut at predetermined lengths. More particularly, the invention relates to a setting and winding mechanism for a tape-like laminate in a laminator which can facilitate the initial setting of the tape-like laminate.

2. Description of the Prior Art

U.S. Pat. No. 4,494,435 discloses a device for cutting a tape-like laminate with this device, only the upper printable layer and the adhesive layer are cut, while the backing substrate is left intact. With this device, it is impossible to cut all of the layers of a laminated strip and to stack cut laminate pieces for individual use.

Furthermore, in an ordinary laminating device in which a printed label strip is laminated thereon with a transparent film, it is difficult to correctly align both the tape-like materials of a label strip and a transparent film in parallel relationship. In practice, both materials are set in a laminator and are overlaid onto each other. A considerable length is passed through the machine so as to provide correct alignment. After that, normal operation is started. It has been found that this produces a waste of expensive materials and the workability cannot be raised.

SUMMARY OF THE INVENTION

It is, therefore, the primary object of the present invention to eliminate the above-described disadvantages in the conventional art.

Another object of the present invention is to provide a new setting and winding mechanism for a tape-like laminate with which the initial setting and aligning of the tape-like materials can be done quite easily without producing significant amounts of waste material.

A further object of the invention is to provide a setting and winding mechanism for tape-like materials in a laminator, with which set strip materials are correctly aligned, then cut at proper positions so as to facilitate the starting of the laminator.

The setting and winding mechanism for a tape-like laminate in a laminator according to the present invention comprises a feeding device for feeding a laminate strip. A take-up device initially winds up the free end of the laminate strip. There is a sensor to detect the position of the laminate strip. A cutter cuts the laminate strip into laminate pieces. Once the label strip has been set up for subsequent cutting and label stacking, a delivery device follows the cutter to deliver the cut laminate pieces. A drive controller is connected to the take up device for operating it until the label strip is set. Thereafter, the delivery device is also operated to move the label strip.

In the above mechanism of the present invention, the delivery device is provided with a driving roller unit and an openable roller unit. When the tape-like materials are in the process of being set, the openable roller unit is opened and the tape-like laminated material is cut along with winding the laminated material is cut along with winding the laminated material, thereby facilitating the setting of tape-like materials to the laminator. Thereafter, the roller unit is closed.

BRIEF DESCRIPTION OF THE DRAWINGS

These and other objects and features of the invention will become more apparent from the following description taken in connection with the accompanying drawings in which.

DESCRIPTION OF PREFERRED EMBODIMENT

Figure 1:
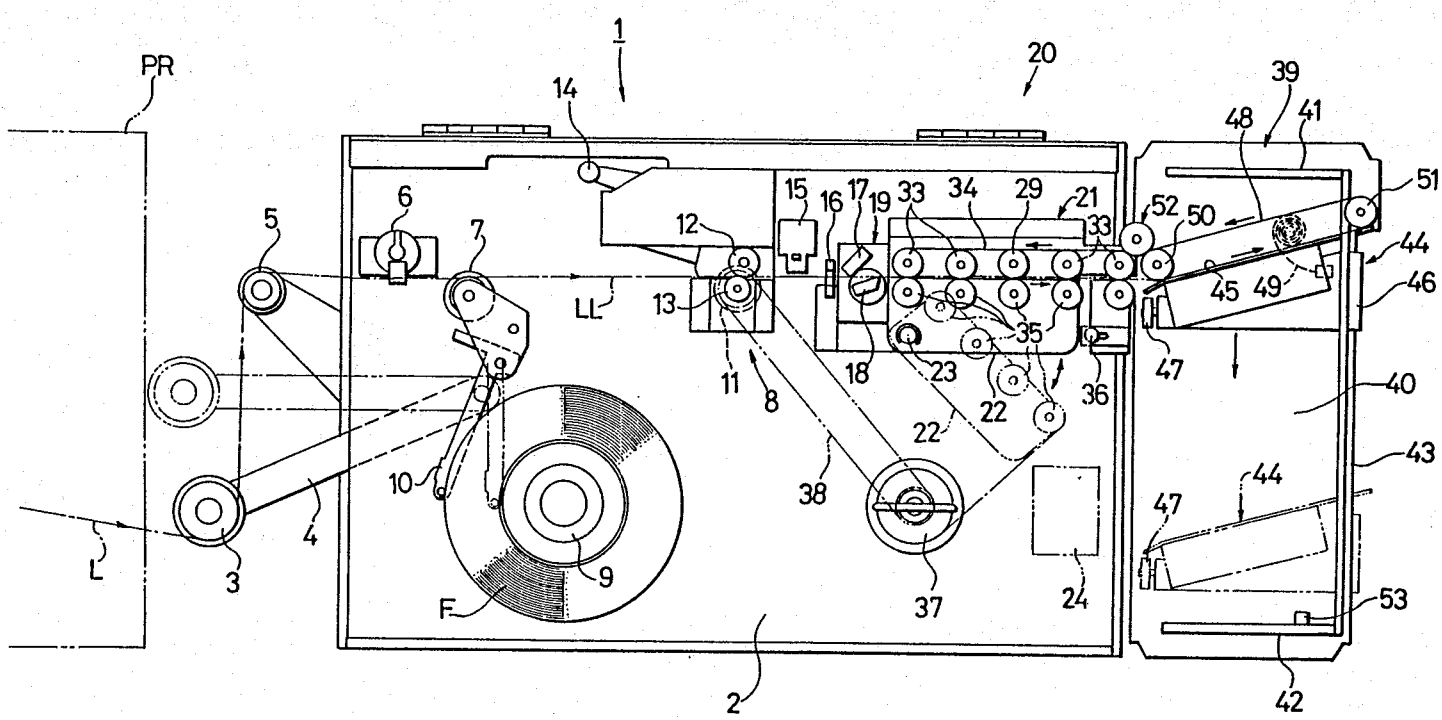
FIG. 1 is a plan view of an embodiment of the mechanism according to the present invention.

FIG. 1 is a plan view showing the whole laminator 1, in which the mechanism of the present invention is incorporated. A printer PR in which predetermined figures and characters are printed on a label strip L is positioned close to the laminator 1. The printer PR supplies the laminator 1 with the printed label strip L. A spring-urged arm 4 having a movable guide roller 3 is pivotally mounted on a base board 2 of the laminator 1. The label strip L from the printer is first turned by the guide roller 3 and is again turned by a stationary guide roller 5. The label strip L is further transferred to a feeding device 8 through a laminating head 6 and a fixed guide roller 7.

A support 9 for a strip of transparent film F is mounted on the base board 2. The film F is paid out from the support 9, passed through a film sensing arm 10 and laminated to the surface of the label strip L to provide a laminate strip LL. This laminate strip LL is then supplied to the feeding device 8.

Figure 2:
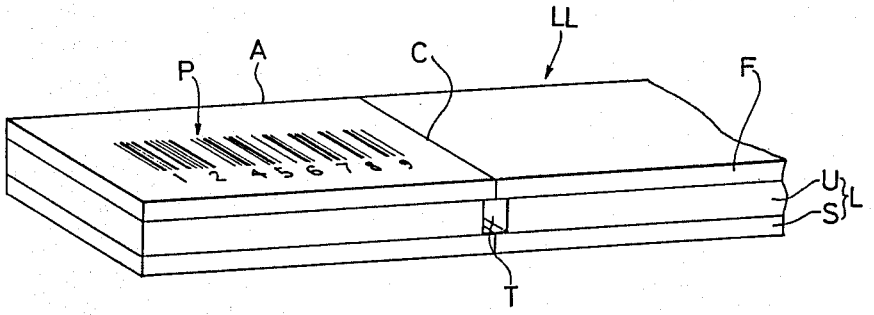
FIG. 2 is a perspective view of a laminate.

The laminate strip LL is shown in more detail in FIG. 2. In the label strip L, pieces of unit labels U are temporarily stuck to a continuous backing paper S. The printed characters P on a unit label U are protected by applying the film F over the label strip L. The laminate strip LL is cut at cutting line C by a rotary cutter device 19 (described below), thereby obtaining label laminates A, having desired sizes or lengths. In order to facilitate the sensing of the position of unit labels U, trimming portions T are formed between adjacent unit labels U.

The laminate strip LL is introduced into the feeding device 8 and then passed through a predetermined passage by a pair of opposing rollers 12 and 13 that are driven by a stepping motor 11. When the laminate strip LL is set or in place, the rollers 12 and 13 are opened apart by moving the knob 14.

On the downstream side of the feeding device 8, there are sensors, which comprise a photo-sensor 15 for sensing eye or printed marks or characters and a photo-sensor 16 for sensing trimming portion T. The sensors 15, 16 can be changed over electrically from one to the other in accordance with the kind of label strip L supplied. In this embodiment, the sensor 16 will be used to detect the trimming portion T.

Following the sensors there is a rotary cutting device 19, which comprises a stationary blade 17 and a rotary blade 18. The label laminates A that have been cut by cutting device 19 are transferred to the outside of the laminator 1 to stacker unit 39 by the delivery device.

The delivery device 20 is provided with a stationary driving roller unit 21 in the upper part and an openable roller unit 22 in the lower part, which can be pivoted about a pivot shaft 23 to an open position, as indicated by the dashed lines in FIG. 1.

Figure 3:
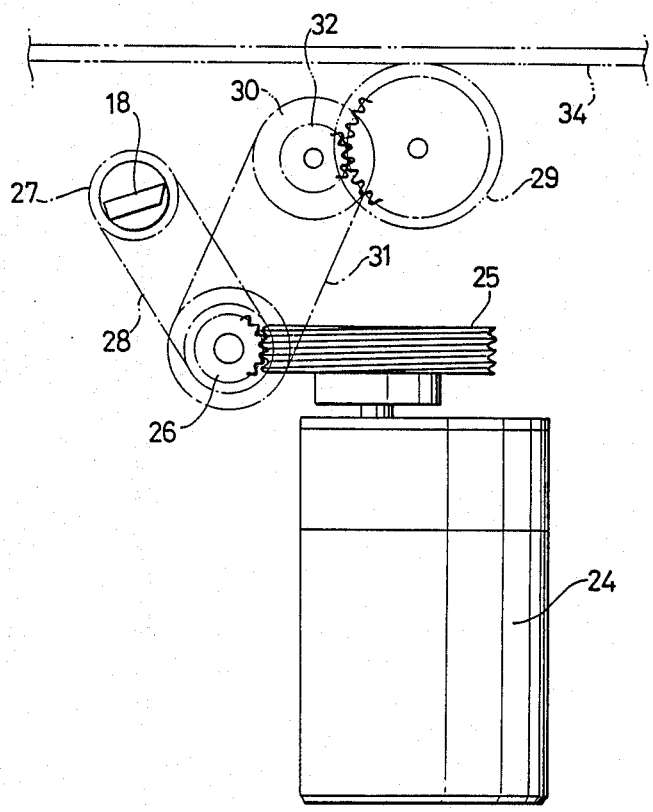
FIG. 3 is a schematic drawing showing the driving mechanism for a cutting means and a delivery means.

The delivery device 20 and the rotary blade 18 are driven by an AC motor 24. As shown in FIG. 3, the AC motor 24 and the rotary blade 18 are connected by a spiral worm gear wheel 25, a driven pulley 26 having a toothed wheel in mesh with the wheel 25, another pulley 27, a belt 28 connecting the pulleys 26 and 27, and a clutch mechanism (not shown). The clutch mechanism connects the motor 24 and the rotary blade 18 when the sensor 16 detects the trimming portion T, and thereafter returns the clutch to its original state. The roller 29 of the driving roller unit 21 is connected to the motor 24 through the wheel 25, the pulley 26, a belt 31 and a toothed wheel 32 in mesh with the roller 29.

Referring to FIG. 1, the roller 29 is connected by a belt 34 to other rollers 33 in the driving roller unit 21. Each of the rollers 29 and 33 are brought into engagement with a respective one of follower rollers 35 in the roller unit 22, thereby delivering a cut label laminate A between the respective pairs of opposing rollers. A knob 36 is used for opening the openable roller unit 22.

A take-up reel 37 is mounted on the lower side of the openable roller unit 22 which is on the base board 2. The forward free end of the laminate strip LL is initially wound on the reel 37, which is connected to the stepping motor 11 by a belt 38.

The delivery device 20 is followed by a stacker unit 39 which includes a plane frame 40, an upper horizontal frame 41, a lower horizontal frame 42, a guide frame 43 at one side portion of frame 40 and frames 41 and 42, and a stacker frame 44. The stacker frame 44 includes a cradle 45 to receive delivered label laminates LL, and it has a movable frame 46 which moves along the guide frame 43, a roller 47 which rolls on the plane frame 40, and a carrying belt 48. The frame 44 moves between its upward, solid line and downward, broken line positions.

A spiral spring 49 is fixed between stacker frame 44 and the plane frame 40, thus always urging the stacker frame 44 upward. The carrying belt 48 is stretched around pulleys 50 and 51. Pulley 50, through gear train 52, is connected to a roller 33 of the driving roller unit 21. The frame 42 is provided with a sensor 53 which produces a stop signal when the stacker frame 44 reaches the lowermost position.

Figure 4:
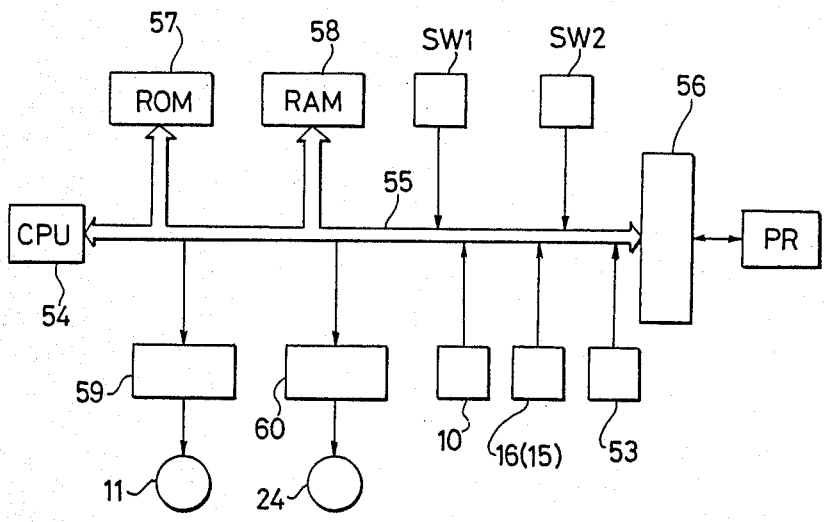
FIG. 4 is a diagram of a driving and controlling circuit.

FIG. 4 shows the drive controlling circuit of the present invention. A central processing unit (CPU) 54 is connected to an interface 56 for a printer PR by way of bus line 55. The bus line 55 is also connected to read only memory (ROM) 57, random access memory 58, switches SW1 and SW2, film sensing arm 10, the sensors 15, 16 and 53, the driving circuit 59 for the stepping motor 11, and the driving circuit 60 for the AC motor 24. The drive controlling circuit controls the sequencing and operation of various components of the present invention. However, since control circuits of this type are readily known and available to one skilled in the art, a detailed description will not be made.

The operation of the mechanism of the present invention will now be described from the point of lamination of the label strip L with the film F. The label strip L that is delivered from the printer PR is passed over the guide rollers 3 and 5 and the laminating head 6. Simultaneously, the film F is paid out from the support device 9 and is applied to the label strip L in the area of the laminating head 6 and the guide roller 7 for obtaining a laminate label strip LL.

The rollers 12 and 13 are initially opened by the knob 14 which allows the laminate strip LL to be passed between the rollers 12 and 13. The laminate strip LL is thereafter passed through the sensors 15 and 16, the rotary cutter 19 and then the delivery device 20 via the driving roller unit 21 of the openable roller unit 22 which is then in the opened position (as shown in dashed line). The openable roller unit 22 is movable downwardly by operating the knob 36.

The free end of the laminate strip LL is passed along the series of follower rollers 35 of the opened openable roller unit 22 and that free end is attached to the take-up reel 37. The start switch SW1 is then turned on to drive the feeding device 8 and to rotate the take-up reel 37. This sets the strip LL before normal operation begins. The switch SW2 at this time remains open.

The laminate strip LL is passed through feeding device 8, sensor 16, rotary cutting device 19 and openable roller unit 22, and is then wound up by the take-up reel 37. When the sensor 16 detects a trimming portion T of the laminate strip LL, the sensor 16 produces a signal to connect the clutch mechanism of the rotary blade 18. The rotary blade 18 is thus actuated to cut the laminate strip LL. The clutch then returns to its open position, and the feeding device 8 is stopped. This operation has initially set up the operation of the machine by allowing the label strip L to be initially mated with the film F and to thereafter pass through the feeding device 8, and it allows sensors 15, 16 to "register" the proper portions of the laminated strip LL.

After the initial steps above, the openable roller unit 22 is closed to its normal position and the start switch SW2 is then turned on to produce a start signal. Thus, the feeding device 8 and delivery device 20 are operated and thereby engage laminate strip LL allowing it to move forward. When a predetermined position in the laminate strip LL is detected by the sensor 16, the laminate strip LL is cut at the predetermined length by the rotary cutting device 19. The cut pieces, label laminates A, are delivered by the delivery device 20 and stacked one by one on the stacker frame 44 of the stacker unit 39. As the stack of cut pieces grows, the stacker frame 44 moves down against the force of the spring 49. When the full travel of the stacker frame 44 is detected by the sensor 53, the operation of the whole mechanism is stopped. The backing paper S of the thus prepared label laminates A can now be peeled off and the adhesive layer on the labels can be applied to the surfaces of desired articles (not shown) such as for data controlling or system controlling. Because the outer surfaces of the label laminates A are protected by the film F, they have excellent properties of wear resistance, weather resistance, water resistance, dust resistance and oil resistance, and therefore have a long service life.

Accordingly, in the present invention, the forward free end of the laminated label strip is first wound up by the take-up reel 37, and the label strip is cut at the stage when the setting is finished. The openable roller unit is then closed to enter into the operation of feeding, cutting and delivering. Accordingly, the mechanism of the invention facilitates the difficult setting of laminated strips.

Although the lamination of labels was described, it is to be understood that the mechanism of the present invention can be used likewise for the lamination of tags, or the like.

Furthermore, the start signal, although produced by the switch SW2, may be produced by the closing operation of the roller unit. Still further, in place of the pivotal motion of the openable roller unit, movement in the perpendicular direction may be used to open it.

Although the present invention has been described in connection with a preferred embodiment thereof, many other variations and modifications will now become apparent to those skilled in the art. It is preferred, therefore, that the present invention be limited not by the specific disclosure herein, but only by the appended claims.

What is claimed is:

1. A setting and winding mechanism for a tape-like laminate strip having a printed medium disposed on said strip, for use in a laminator, the setting and winding mechanism comprising:

a feeding device for moving the tape-like laminate strip through the mechanism;

a take-up device for receiving a leading end of the tape-like laminate strip from the feeding device, the feeding device and take-up device being responsive to a first start signal to feed the laminate strip from the feeding device to the take-up device during a setting mode of the mechanism;

sensing means for detecting predetermined positions on the tape-like laminate strip and for producing an output signal in response to detection of the positions;

cutting means disposed relative to the laminate strip for cutting the laminate strip at predetermined locations thereof, in response to the output signal;

delivery means for receiving successively cut laminate pieces from the cutting means, the delivery means and the feeding device being responsive to a second start signal to feed the laminate strip past the cutting means and for delivering the cut pieces out of the setting and winding mechanism;

a first start switch and a second start switch for initiating, respectively, the first and second start signals; and drive controlling means coupled to the feeding device, to the take-up device and to the delivery means for causing the leading end of the tape-like laminate strip to be wound on the take-up device in response to the first start signal and for causing the cutting means to produce the cut laminate pieces and the delivery means to delivery the cut pieces out of the setting and winding mechanism.

2. A setting and winding mechanism according to claim 1, further comprising a stacking device disposed adjacent the delivery means for receiving the cut laminate pieces and for stacking the pieces over one another to produce stacks of the cut laminate pieces.

3. A setting and winding mechanism for a tape-like laminate strip having a printed medium disposed on said strip, for use in a laminator, the setting and winding mechanism comprising:

a feeding device for moving the tape-like laminate strip through the mechanism;

a take-up device for receiving a leading end of the tape-like laminate strip from the feeding device, the feeding device and take-up device being responsive to a first start signal to feed the laminate strip from the feeding device to the take-up device during a setting mode of the mechanism;

sensing means for detecting predetermined positions on the tape-like laminate strip and for producing an output signal in response to detection of the positions;

cutting means disposed relative to the laminate strip for cutting the laminate strip at predetermined locations thereof, in response to the output signal;

delivery means for receiving successively cut laminate pieces from the cutting means, the delivery means and the feeding device being responsive to a second start signal to feed the laminate strip past the cutting means and for delivering the cut pieces out of the setting and winding mechanism, the delivery means including a first roller unit and a second openable roller unit, the openable roller unit having an open position which is away from the first roller unit for enabling movement of the tape-like laminate strip to the take-up device during the setting mode and further having a closed position which is toward the first roller unit, at the closed position, the first and second roller units cooperating with one another for moving the cut laminate pieces through the deliver means;

a first start switch and a second start switch for initiating, respectively, the first and second start signals; and drive controlling means coupled to the first and second start switches, to the feeding device, to the take-up device and to the delivery means, the drive controlling means being effective for generating the first and second start signals, and being connected to the sensing means for delivering the output signal of the sensing means to the cutting means, the drive controlling means being further effective for supplying the second start signal to the feeding device and to the delivery means when the openable roller unit is in its closed position.

* * * * *